US009701516B2

(12) United States Patent
Karimpanackal Natarajan et al.

(10) Patent No.: US 9,701,516 B2
(45) Date of Patent: Jul. 11, 2017

(54) PROTECTIVE ARRANGEMENT FOR AN ELEVATOR

(71) Applicant: KONE CORPORATION, Helsinki (FI)

(72) Inventors: Nithil Karimpanackal Natarajan, Helsinki (FI); Samuli Mäntynen, Espoo (FI)

(73) Assignee: KONE CORPORATION, Helsinki (FI)

( * ) Notice: Subject to any disclaimer, the term of this patent is extended or adjusted under 35 U.S.C. 154(b) by 566 days.

(21) Appl. No.: 14/247,822

(22) Filed: Apr. 8, 2014

(65) Prior Publication Data

US 2014/0216860 A1 Aug. 7, 2014

Related U.S. Application Data

(63) Continuation of application No. PCT/FI2012/050931, filed on Sep. 27, 2012.

(30) Foreign Application Priority Data

Oct. 21, 2011 (FI) ..... 20116040

(51) Int. Cl.
*B66B 13/28* (2006.01)

(52) U.S. Cl.
CPC ..... *B66B 13/285* (2013.01); *B66B 13/28* (2013.01)

(58) Field of Classification Search
CPC ..... B66B 13/28; B66B 13/285
See application file for complete search history.

(56) References Cited

U.S. PATENT DOCUMENTS 6,095,288 A * 8/2000 Rivera ..... B66B 5/28 187/343

FOREIGN PATENT DOCUMENTS

CN 1982195 A 6/2007
DE 100 65 101 A1 7/2002
(Continued)

OTHER PUBLICATIONS

Finnish Patent Office Search Report, 20116040, Aug. 15, 2012, pp. 1.

(Continued)

*Primary Examiner* — William A Rivera
*Assistant Examiner* — Stefan Kruer
(74) *Attorney, Agent, or Firm* — Birch, Stewart, Kolasch & Birch, LLP

(57) ABSTRACT

An elevator having an elevator car configured to move in a hoistway, and floor landings, and a protective arrangement, which arrangement has a wall connected to the bottom of the car, which protective wall can be displaced between a vertical operating position and a retracted position folded out of the vertical operating position, and when in which operating position the wall forms a wall extending downwards from the bottom edge of the floor landing side of the elevator car, and in which elevator the protective arrangement has locking means for preventing the protective wall in the operating position from folding out. The locking means has one or more movable locking means, which is/are arranged to be moved between a locking and retracted position, when in which locking position the locking means prevents the wall in the operating position from folding out of the operating position towards the retracted position.

20 Claims, 3 Drawing Sheets

(56) References Cited

FOREIGN PATENT DOCUMENTS

| | | | | | |
|---|---|---|---|---|---|
| DE | 10115990 | C1 | * | 10/2002 | ..... B66B 13/285 |
| DE | EP 1524234 | A1 | * | 4/2005 | ..... B66B 13/285 |
| EP | 1914190 | A1 | | 4/2008 | |
| FI | 117827 | B | | 12/2006 | |
| FR | 2841886 | A1 | * | 1/2004 | ..... B66B 13/285 |
| JP | 2005-145610 | A | | 6/2005 | |
| JP | 2006-264809 | A | | 10/2006 | |
| WO | WO 00/64798 | A1 | | 11/2000 | |
| WO | WO 02/60802 | A2 | | 6/2002 | |

OTHER PUBLICATIONS

Supplementary European Search Report, EP 12 84 2638, Aug. 25, 2015, pp. 1-6.

* cited by examiner

PROTECTIVE ARRANGEMENT FOR AN ELEVATOR

CROSS REFERENCE to RELATED APPLICATIONS

This application is a Continuation Application of PCT/FI2012/050931 filed on Sep. 27, 2012, which claims priority under 35 U.S.C. 119(a) to Patent Application No. 20116040 filed in Finland on Oct. 21, 2011, all of which are hereby expressly incorporated by reference into the present application.

FIELD OF THE INVENTION

The object of the invention is an elevator, more particularly an elevator applicable to the transporting of a person and/or of freight.

BACKGROUND OF THE INVENTION

The invention relates to a safety device comprised in an elevator car of an elevator. According to prior art, a protective structure is connected to the bottom part of an elevator car configured to move in an elevator hoistway, which protective structure is either permanently in a vertical position or can be temporarily displaced into a vertical position, when in which vertical position the protective structure forms a vertical protective wall extending downwards from the bottom edge of the door aperture side of the elevator car. The protective wall is called, in English, an apron or a toe guard. A protective wall is needed when stopping the elevator car between floors, because in this case the bottom edge of the elevator car remains above the floor level. An open aperture leading into the hoistway in this case remains between the bottom edge and the floor level, which aperture the aforementioned protective wall is intended to cover. When the protective wall is in a vertical position it covers the aforementioned aperture, so that the transfer of a person or of freight into the hoistway via the aperture is prevented.

It is often appropriate to form the pit of elevator hoistways to be shallow, i.e. the distance between the bottom of the elevator hoistway and the sill of the bottommost floor landing to be short, even shorter than the space needed by the aforementioned protective wall in the vertical position. Owing to this, it is advantageous to connect the aforementioned protective wall to the elevator car in a manner that allows folding, such that the protective wall can be displaced between a vertical operating position and a retracted position folded out of the vertical operating position, when it is in which retracted position the protective wall takes up less space below the car in the vertical direction than when it is in the operating position. A problem with a folding-type protective wall is that the unintended moving of it out of the operating position must somehow be prevented. More particularly the folding of a protective wall out of the operating position under the weight of a person leaning on the protective wall could cause a dangerous situation. For this reason it has been possible to lock the protective wall into the operating position by the aid of separate locking mechanisms. The locking means have, however, been complicated and forming them to be durable and reliable in a space-efficient manner has been awkward.

BRIEF DESCRIPTION OF THE INVENTION

The aim of the invention is to solve the problems of prior-art solutions and to produce an elevator that is improved with respect to the safety devices of the elevator car. More particularly it is endeavored with the invention to prevent unintentional displacement of the protective wall of the elevator car out of its intended position. Further, it is endeavored with the invention to disclose a simple and space-efficient solution for locking a protective wall into its operating position.

The elevator according to the invention comprises an elevator car configured to move in an elevator hoistway, and floor landings, and a protective arrangement, which protective arrangement comprises a protective wall connected to the bottom part of the elevator car, which protective wall can be displaced between a vertical operating position and a retracted position folded out of the vertical operating position, and when in which operating position the protective wall forms a wall extending downwards from the bottom edge of the floor landing side of the elevator car, and in which elevator the aforementioned protective arrangement comprises locking means for preventing the protective wall in the operating position from folding out of the operating position. The locking means comprise one or more movable locking means, which is/are arranged to be moved between a locking position and a retracted position, when in which locking position the locking means prevents the protective wall in the operating position from folding out of the operating position towards the retracted position. Thus it can be ensured that the protective wall does not give way accidentally, and e.g. leaning on it is safe.

In a preferred embodiment the locking means is arranged to move into the locking position if the protective wall moves from the retracted position into the operating position. Thus if the protective wall is brought into the operating position, it does not return back without dismantling the locking. Consequently, it can be ensured that leaning on the protective wall is safe.

In a preferred embodiment a force (F2) is arranged to be exerted on the locking means in the retracted position, pushing it towards the locking position, which force is preferably the gravity of the earth and/or the spring force of a possible spring means. In this way automatic displacement into locking can be achieved without any manual procedures and without complex actuators.

In a preferred embodiment when the protective wall is in the retracted position, a force is arranged to be exerted on the locking means in the retracted position, pushing it towards the locking position, which force is preferably the gravity of the earth and/or the spring force of a possible spring means. In this way automatic displacement into locking can be achieved without any manual procedures and without an actuator. Preferably other forces moving it into the locking position are not exerted on the locking means, in which case its operation is in this respect independent. Preferably the displacement of the protective wall into the operating position does not force the locking means into the locking position, but instead that happens by the aid of the aforementioned force (F2) exerted on the locking means, which force is preferably a separate force than the force (F1) pushing the protective wall into the operating position.

In a preferred embodiment the moving of the locking means into the locking position is arranged to be prevented when the protective wall is in the retracted position. This is preferably implemented such that when it is in the retracted position the protective wall is arranged to prevent movement of the locking means into the locking position. For example, a part of the protective wall can be on the route leading to the locking position of the locking element.

In a preferred embodiment a force is arranged to be exerted on the locking means in the retracted position, pushing it towards the locking position, and the moving of the protective wall from the retracted position into the operating position is arranged to release the locking means to move into the locking position from the effect of the aforementioned force (F2).

In a preferred embodiment the locking means is arranged to move between a locking position and a retracted position with a vertical movement. In this way the locking means is not itself able to move in the aforementioned direction during the locking movement or during the removal of it, and that being the case is not itself able to move in that direction in which it is intended to prevent movement of the protective wall occurring.

The locking means is preferably an elongated, flexurally stiff member, which when in the retracted position is in a vertical position. Thus it can displaced simply to extend to below and to support the protective wall adequately from below. Also a vertical linear movement is thus easy to arrange.

In a preferred embodiment the locking means is an elongated, flexurally stiff member, and the locking means is arranged to move between a locking position and a retracted position with a linear movement, preferably with a longitudinal linear movement of the locking means. Thus its path of movement does not require a large space, and space can be found for it into which it can be fitted when it is in the retracted position. It is very simple, in terms of the construction, to arrange a linear movement and to form the movement to be controlled. As the linear movement occurs in the longitudinal direction, the usage of transverse space in relation to the stiffening effect to be achieved is small.

In a preferred embodiment the locking means, when in the retracted position, is at least partly beside the door aperture of the elevator car. Thus the locking means is in the vertical direction overlapping with the door aperture and the length of the locking means can be configured to be sufficiently long, because the whole height of the elevator car is available for use.

In a preferred embodiment the protective wall comprises an upper wall part and a lower wall part, which are connected to each other telescopically, and that a forcing means is in connection with the lower wall part, which, when raising the lower wall part when the wall is in the operating position, is arranged to force the locking means out of the locking position. Thus when manually raising the lower wall part, the locking can be simply dismantled and the protective wall folded under the elevator car into the sphere of effect of the holding means.

In a preferred embodiment a force (F1) is arranged to be exerted on the protective wall in the retracted position, pushing it towards the operating position, which force is preferably the gravity of the earth and/or the spring force of a possible spring means, and that the protective arrangement comprises holding means for holding the protective wall in the retracted position, which holding means can be freed to let the protective wall displace from the retracted position into the operating position from the effect of the aforementioned force.

In a preferred embodiment the holding means are arranged to release the protective wall if the elevator car stops between consecutive floor landings. In this way the displacement of the protective wall into the operating position can be achieved automatically and the elevator switches automatically into a safe mode in the case of the aforementioned exceptional situation. For this purpose the elevator preferably comprises means, which are able to disconnect the hold of the holding means if the elevator car stops between floor landings. These means can e.g. comprise a control, which disconnects the hold in the aforementioned situation, or disconnection of the safety circuit of the elevator can result in disconnection of the electrical energy needed for the hold of the holding means and thereby in release of the hold. The holding means are preferably electrically driven, e.g. with an actuator, such as acting with a solenoid actuator. The aforementioned ways to implement are simple and utilize existing elevator components.

In a preferred embodiment the locking means is arranged to be manually returned from the locking position into the retracted position. In this way switching the elevator into normal mode after a fault situation can only occur by the action of a person, who is for certain on site inspecting the fault situation.

In a preferred embodiment the protective wall is arranged to be manually returned from the operating position into the retracted position. In this way switching the elevator into normal mode after a fault situation can only occur by the action of a person, who is for certain on site inspecting the fault situation.

In a preferred embodiment the aforementioned force (F1 and/or F2) is achieved without an electrically-driven actuator, e.g. gravity and/or with the spring force of a possible spring means. In this way the movement into the operating position/locking position is also safe from the viewpoint of equipment failure.

In a preferred embodiment the distance between the base of the pit of the elevator hoistway and the top surface of the sill of the bottommost floor landing is smaller than the distance between the top surface of the sill of the elevator car and the bottom edge of the protective wall in the operating position. In this case a folding protective wall enables a shallow pit, but safe protection.

In a preferred embodiment the protective arrangement comprises two aforementioned locking means, at a horizontal distance from each other. In this case when they are in the retracted position each of these two locking means is at least partly beside the door aperture, on opposite sides of the door aperture of the elevator car. Thus a robust support is achieved in a space-efficient way. The locking means are in this case preferably vertical, and preferably otherwise in the way described elsewhere.

In a preferred embodiment the locking means is supported on the elevator car to move between a locking position and a retracted position in a supported manner along a predefined trajectory, preferably in a controlled manner, e.g. in a controlled manner by the aid of guide rails such as a guide rail channel. The guide rail channel is supported in its position on the elevator car. Preferably the locking means travels inside the guide rail channel. The guide rail channel is preferably a tube, inside which the locking means is able to move. The locking means can also be a tube, preferably of a metal material.

In a preferred embodiment the locking means is at least 30 cm long, more preferably at least 50 cm long or more, in which case the support effect and rigidity it provides is available simply and adequately. Likewise its own mass is sufficient to press it dependably into its locking position. The locking means is preferably metal.

It is advantageous that the locking means is in the locking position behind the protective wall in the operating position (as viewed from the floor landing), in which case the structure is simple to implement. It is also advantageous that the locking means is in a vertical position when it is in the retracted and in the operating position. The locking means is preferably at least 30 cm long, and extends in the operating position to at least 20 cm below the center of rotation of the protective wall. The elevator is most preferably an elevator applicable to the transporting of people and/or of freight, which elevator is installed in a building, to travel in a vertical direction, or at least in an essentially vertical direction, preferably on the basis of landing calls and/or car calls. The elevator car preferably has an interior space, which is most preferably suited to receive a passenger or a number of passengers. The elevator preferably comprises at least two, preferably more, floor landings to be served. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments.

BRIEF DESCRIPTION OF THE FIGURES

The invention will now be described mainly in connection with its preferred embodiments, with reference to the attached drawings, wherein.

DETAILED DESCRIPTION OF THE INVENTION

Figure 1:
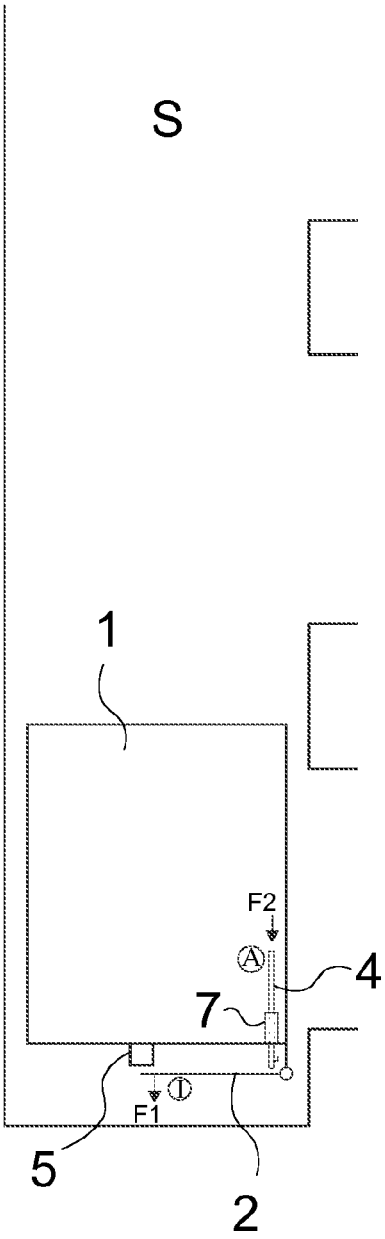
FIG. 1 presents by way of reference an elevator according to the invention, in which the protective wall of the protective arrangement is out of the operating position in the retracted position I.
Figure 2:
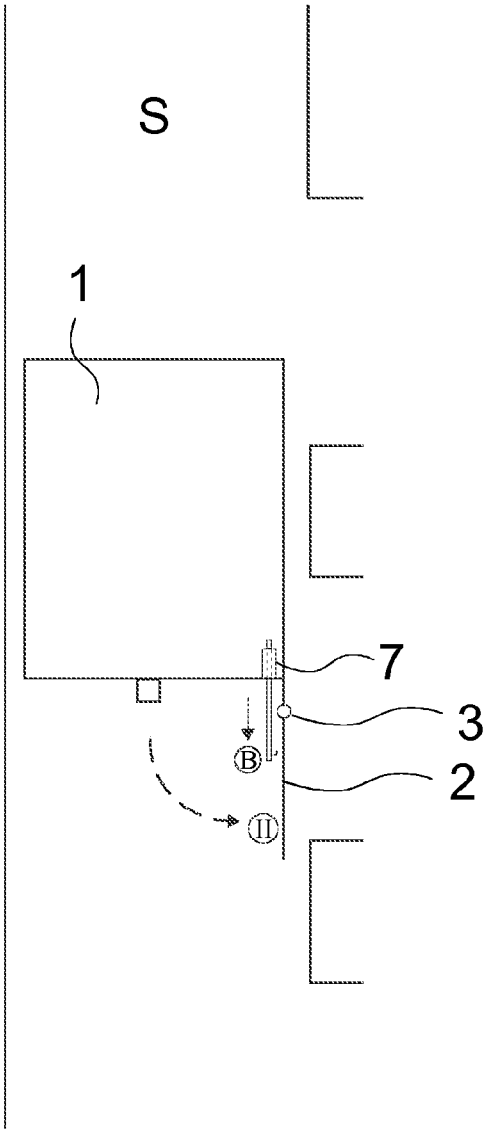
FIG. 2 presents by way of reference an elevator according to FIG. 1, in which the elevator car has stopped between floor landings and the protective wall of the protective arrangement is in the operating position II.

FIG. 1 presents an elevator according to the invention, which comprises an elevator car 1 configured to move in an elevator hoistway S, and floor landings, and a protective arrangement, which protective arrangement comprises a protective wall 2 connected to the bottom part of the elevator car 1. The protective wall 2, as presented in the figure, is in the retracted position I taking up little vertical space below the elevator car 1. In this way the elevator car 1 could be driven very close to the base of the pit of the elevator hoistway S. FIG. 1 presents the elevator car in a situation according to normal drive, wherein the elevator car 1 has stopped at the point of the (bottommost) floor landing, in which case the sill of the door aperture of the elevator car 1 is level with the sill of the floor landing. Since the elevator car 1 is in normal drive, there is no access from the floor landing to below the elevator car 1, and the protective wall does not need to be in the operating position II. The protective wall 2 can be displaced from a retracted position I into a vertical operating position II by folding around a center of rotation 3. The center of rotation 3 is preferably in the proximity of the edge of the elevator car 1 on the floor landing side. FIG. 2 presents the elevator according to FIG. 1, in a situation in which the protective wall 2 is folded into the vertical operating position II, when in which operating position II the protective wall 2 forms a wall extending downwards from the bottom edge of the floor landing side of the elevator car 1, which covers in its width at least essentially the whole width of the door aperture of the floor landing. The protective arrangement comprises locking means 4,7 for preventing the protective wall 2 in the operating position II from folding out of the operating position II, which locking means 4,7 comprise a movable locking means 4, which is arranged to be moved between the retracted position A and the locking position B. FIG. 1 presents the locking means 4 in the retracted position A, and FIG. 2 presents it in the locking position B, in which locking position B the locking means 4 prevents the protective wall 2 in the operating position II from folding out of the operating position II back into the retracted position I. When it is in the retracted position A, the locking means 4 allows folding of the protective wall 2 out of the operating position II into the retracted position I.

The protective arrangement also comprises holding means 5 for holding the protective wall 2 in the retracted position. A force F1 is arranged to be exerted on the protective wall 2 in the retracted position I, pushing it towards the operating position II, which force is preferably the gravity of the earth and/or the spring force of a possible spring means. The holding means 5 can be freed to let the protective wall 2 displace from the retracted position I into the operating position II from the effect of the aforementioned force F1. It is advantageous that the holding means 5 are arranged to release the protective wall 2 if the elevator car 1 stops between consecutive floor landings. It is advantageous to arrange this to occur automatically. For this purpose the elevator comprises means (not presented), which are able to bring about disconnection of the hold of the holding means 5 if the elevator car 1 stops between floor landings. These means can e.g. comprise a control, which disconnects the hold in the aforementioned situation, or disconnection of the safety circuit of the elevator can result in disconnection of the electrical energy needed for the hold of the holding means and thereby in release of the hold. The holding means 5 are preferably electrically driven, e.g. with an actuator, such as acting with a solenoid actuator. The aforementioned force F1 acting on the protective wall is preferably achieved passively, i.e. without an electrically-driven actuator, e.g. gravity and/or the spring force of a possible spring means (gravity in the figures). The holding means 5 can operate e.g. on the principle presented in FIGS. 3-5 and the part 9 of the protective wall 2 can be locked with a solenoid, or corresponding, to the part 10 supported on the elevator car.

The locking means 4 is arranged to move into the locking position B if the protective wall 2 moves from the retracted position I into the operating position II. Thus the return of the protective wall 2 from the operating position II is therefore prevented such that the return first requires dismantling of the locking. Displacement of the locking means 4 into the locking position is enabled in the embodiment presented such that a force F2 is arranged to be exerted on the locking means 4 in the retracted position, pushing it towards the locking position B, which force F2 is preferably the gravity of the earth and/or the spring force of a possible spring means. Gravity is presented in the figures, but in addition, or as an alternative to, it the assisting spring force of a spring means could be utilized, which spring means would be arranged to exert a pushing force on the locking means while being supported on the elevator car 1. When it is in the retracted position I the protective wall 2 is arranged to prevent the locking means 4 from moving into the locking position B. The structure of the protective wall 2 is for this purpose in the way of the locking means such that the locking means is not able to displace into the locking position. The moving of the protective wall 2 from the retracted position I into the operating position II is arranged to release the locking means 4 to move into the locking position B from the effect of the aforementioned force F2. Thus displacement into the locking position is only able to occur when the protective wall 2 is in a predefined suitable position, more particularly in the operating position.

The locking means 4 is arranged to move between a locking position B and a retracted position A with a vertical movement, more particularly without movement in the depth direction of the car 1 (depth direction here is the direction from the door aperture of the car towards the rear wall of the car). In this way the locking means 4 is not itself able to move in the aforementioned direction during the locking movement or during the removal of it, and that being the case is not itself able to move in that direction in which it is intended to prevent movement of the protective wall occurring. In this way the locking function of the locking means is reliable. The locking means 4 is an elongated, flexurally stiff member, and the locking means 4 is arranged to move between a locking position B and a retracted position A with a longitudinal linear movement of the locking means. The locking means, when in the retracted position, is in a vertical position. Thus its path of movement does not require a large space, and space can be found for it into which it can be fitted when it is in the retracted position. In the embodiment presented the locking means, when in the retracted position, is at least partly beside the door aperture of the elevator car. In this way the length of the locking means can be configured to be sufficiently long, and the locking means can support the protective wall from sufficiently below, preferably extending behind the protective wall (as viewed from the floor landing) for a distance of at least 15 cm, preferably at least 20 cm, preferably even more. The support effect of the locking means is exerted on the protective wall either in point-form, as is presented, or alternatively for a longer contact distance, preferably however such that the support point, or part thereof, is at least 15 cm away from the center of rotation 3. When it is in the locking position B the locking means 4 itself can be supported on the elevator car 1 for a long distance, preferably for a distance of at least 15 cm, preferably even more. The locking means is preferably at least 30 cm long, in which case the support effect and rigidity it provides is available simply and adequately. When it is in the retracted position, the locking means 4 is preferably partly inside the sill structure that is below the door aperture of the elevator car and that continues to the edges of the elevator car, in which case it takes up little space on the edges of the door aperture. It is advantageous that the protective arrangement comprises two locking means 4 of the aforementioned type, at a horizontal distance from each other. When they are in the retracted position A, these two locking means 4 are in this case preferably beside the aperture of the elevator car 1, each at least partly beside the door aperture O of the elevator car 1, on opposite sides in the manner described above. In this case in FIG. 3 on the right-hand side of the door aperture there is also a structure corresponding to the structure visible on the left-hand edge of the door aperture. The more detailed placement of the two locking means can be further seen in FIG. 5. In each of the embodiments described, it is advantageous that the locking means 4 is supported on the elevator car to move between a locking position and a retracted position in a supported manner along a predefined trajectory, in a controlled manner, e.g. by the aid of guide rails, such as a guide rail channel 7. In the embodiment presented the locking means travels in a guide rail channel 7, which guide rail channel is preferably a tube, inside which the locking means is able to move. The guide rail channel 7 is supported in its position on the elevator car 1. The movement of the locking means 4 is limited such that it is able to move only a certain distance along a certain trajectory. The elevator can in this case comprise movement limiting means 4', 8, preferably as presented in FIGS. 3-5. The movement limiting means could be of another type, e.g. at the top end of the locking means 4 could be a movement limiting protrusion, which would prevent the locking means from progressing over a certain point in the guide rail channel.

Figure 3:
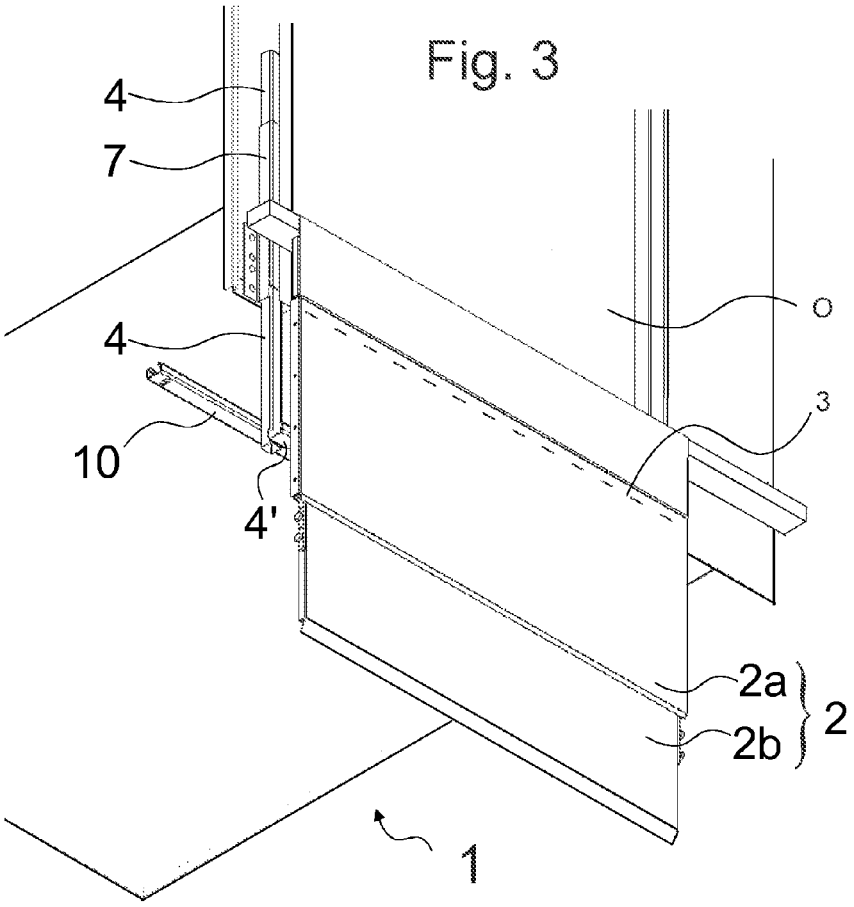
FIG. 3 presents in more detail a preferred construction of the protective wall of the elevator according to FIGS. 1-2 when the protective wall is in the operating position II.
Figure 4:
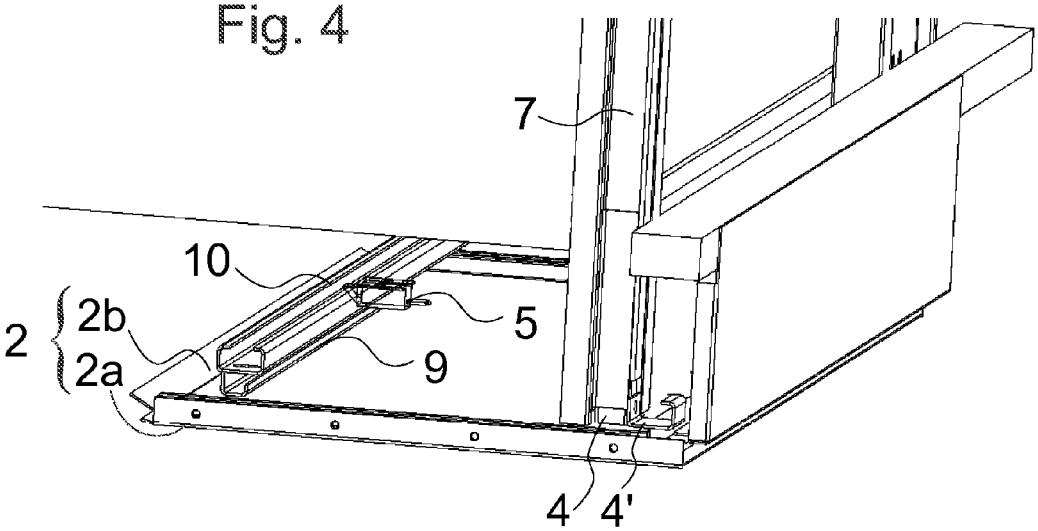
FIG. 4 presents a preferred construction of the protective wall of the elevator according to FIG. 3 when the protective wall is in the retracted position I.
Figure 5:
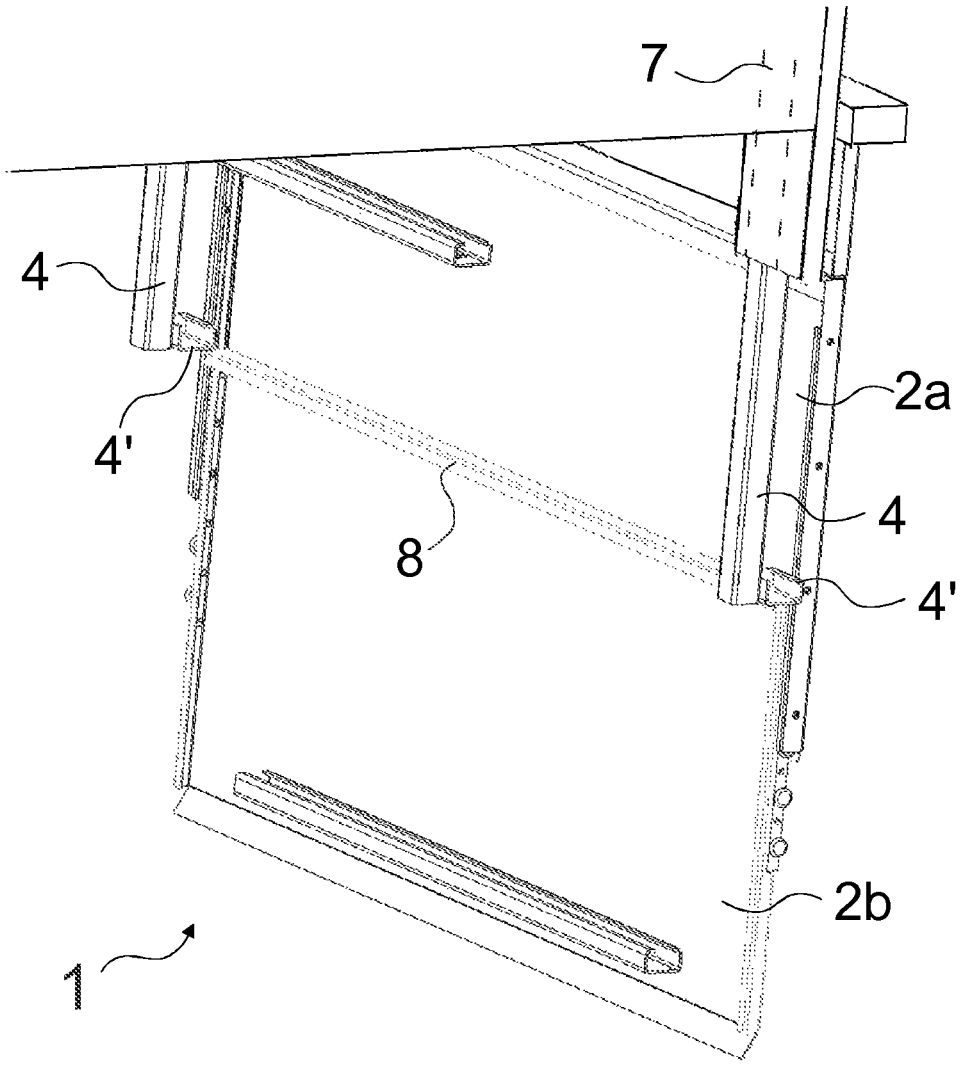
FIG. 5 presents an oblique bottom view of a preferred construction of the protective wall of the elevator according to FIGS. 3-4 when the protective wall is in the operating position II.

In FIGS. 1 and 2 the protective wall 2 is described as comprising only one wall part, but the protective wall 2 presented also in these figures can be formed from more than one wall part, said wall parts moving in relation to each other. In the other figures an advantageous implementation can be seen in more detail for the embodiment described in connection with FIGS. 1-2. The matters described in connection with FIGS. 1-2 also hold true for the more exact embodiments of the other figures. FIGS. 3 and 5 present a protective wall 2 in the operating position II and FIG. 4 in the retracted position I. The center of rotation 3 is described in the figure with a dashed line, because the pivoting is inside the structure. The pivoting can be any prior-art pivoting. As presented in FIG. 3, the protective wall 2 comprises an upper wall part 2*a* and a lower wall part 2*b*, which are connected to each other telescopically. The telescopic structure can be any prior-art telescopic structure. Relative movement between the wall parts 2*a* and 2*b* of the telescopic section has been enabled to occur in the vertical direction. In this case the protective wall 2 is in the retracted position I, preferably telescopically contracted, (not, however, necessarily), and the holding means 5 are suitably disposed to enable holding and to release from the hold. In the figures presented the protective wall 2 is in the retracted position I telescopically contracted, in which case it takes up little space from below the car 1. A movement limiting means 4' is in connection with the locking means 4 (being integral or rigidly fixed), which movement limiting means is arranged to rest in its direction of movement on a detent part 8 that is in connection with the protective wall 2 when the protective wall 2 is in the operating position II and when the locking means 4 is in the locking position B. In this way the locking means 4 is not able to progress too far downwards. On the other hand, by the aid of its telescopic nature, simple operation of the protective arrangement, more particularly the dismantling of the locking, is also enabled. Namely, in the embodiment presented the detent part 8 in connection with the lower wall part 2*b* is, when raising the lower wall part 2*b* when the wall 2 is in the operating position II, arranged to force the locking means 4 out of the locking position B. When the protective wall 2 folds into the operating position II, the detent part 8 is arranged to fold into a position in which it is at the point of the part 4' of the locking means 4 in the transverse direction. In this way, therefore, when moved in the vertical direction during the telescopic movement it is able to push the locking means 4 upwards into the retracted position and folding of the protective wall into the retracted position is enabled. Preferably the movement limiting means 4' in connection with the locking means 4 is additionally arranged to rest in its direction of movement on some part of the protective wall 2 when the protective wall 2 is in the retracted position I and when the locking means 4 is in the retracted position B. Thus displacement into the locking position is only able to occur when the protective wall 2 is in a predefined suitable position. FIG. 5 presents an elevator car 1 from an angle, from which it can be seen how the protective arrangement comprises the two locking means 4 of the aforementioned type, at a horizontal distance from each other.

The return of the protective wall 2/locking means 4 into the retracted position (I; A) preferably occurs manually by the action of a person. In this way switching the elevator into normal mode after a fault situation can only occur by the action of a person, who is for certain on site inspecting the fault situation. As stated above, the protective wall 2/locking means 4 can be displaced into the operating position/locking position (I, II; A, B) in different ways, however preferably by the aid of gravity (advantage of simplicity) and/or of a spring force. Alongside this, an alternative for this function is manual displacement occurring by the action of a person.

The force being exerted on the locking means 4 or on the protective wall 2, pushing it from one position into another, must be understood to be possible to achieve by the aid of a pushing spring or a pulling spring, likewise the gravity of the earth must be understood to exert a force on the locking means or on the protective wall pushing it from one position into another. It is obvious to the person skilled in the art that in developing the technology the basic concept of the invention can be implemented in many different ways. The invention and the embodiments of it are not therefore limited to the examples described above, but instead they may be varied within the scope of the claims. It is also obvious that the functions can be performed in many alternative ways.

The invention claimed is:

1. An elevator, comprising:

an elevator car configured to move in an elevator hoistway;

floor landings; and a protective arrangement comprising a protective wall connected to a bottom part of the elevator car, wherein the protective wall can be displaced between a vertical operating position and a retracted position rotated from the vertical operating position, wherein the protective wall forms a wall extending downwards from a bottom edge of a floor landing side of the elevator car in the vertical operating position, wherein the protective arrangement further comprises a lock for preventing the protective wall in the vertical operating position from rotating out of the vertical operating position, wherein the lock comprises at least one movable elongated locking member linearly movable in the direction of the elevator hoistway, which is arranged to be moved between a locking position and a retracted position, wherein in the locking position, the lock prevents the protective wall in the vertical operating position from rotating out of the vertical operating position towards the retracted position, and wherein in the retracted position, the lock allows rotation of the protective wall out of the vertical operating position into the retracted position.

2. The elevator according to claim 1, wherein a force is arranged to be exerted on the protective wall in the retracted position, urging it towards the vertical operating position, which force is the gravity of the earth and/or the spring force of a spring, wherein the protective arrangement further comprises holder comprising an actuator for holding the protective wall in the retracted position, and wherein the holder can disengage from the protective wall to allow the protective wall to displace from the retracted position into the vertical operating position from the effect of the aforementioned force.

3. The elevator according to claim 2, wherein the holder is arranged to release the protective wall if the elevator car stops between consecutive floor landings.

4. The elevator according to claim 1, wherein the lock is arranged to move into the locking position if the protective wall moves from the retracted position into the vertical operating position.

5. The elevator according to claim 4, wherein a force is arranged to be exerted on the lock in the retracted position, pushing it towards the locking position, which force is the gravity of the earth and/or a spring force of a spring.

6. The elevator according to claim 4, wherein the moving of the lock into the locking position is prevented when the protective wall is in the retracted position.

7. The elevator according to claim 4, wherein the moving of the protective wall from the retracted position into the vertical operating position is arranged to release the lock to move into the vertical locking position.

8. The elevator according to claim 1, wherein a force is arranged to be exerted on the lock in the retracted position, urging it towards the locking position, which force is preferably the gravity of the earth and/or a spring force of a spring.

9. The elevator according to claim 8, wherein the moving of the lock into the locking position is arranged to be prevented when the protective wall is in the retracted position.

10. The elevator according to claim 8, wherein the moving of the protective wall from the retracted position into the vertical operating position is arranged to release the lock to move into the locking position.

11. The elevator according to claim 1, wherein moving of the lock into the locking position is prevented when the protective wall is in the retracted position.

12. The elevator according to claim 1, wherein the moving of the protective wall from the retracted position into the vertical operating position is arranged to release the lock to move into the locking position.

13. The elevator according to claim 1, wherein the lock is arranged to move between a locking position and a retracted position with a vertical movement.

14. The elevator according to claim 1, wherein the lock is arranged to move between a locking position and a retracted position with a linear movement.

15. The elevator according to claim 1, wherein the lock is arranged to move between a locking position and a retracted position with a linear movement of the at least one movable elongated locking member.

16. The elevator according to claim 1, wherein the lock, when in the retracted position, is at least partly beside a door aperture of the elevator car.

17. The elevator according to claim 1, wherein the lock is in a vertical position toward the top of the elevator hoistway when it is in the retracted position and/or in the locking position.

18. The elevator according to claim 1, wherein the lock is supported on the elevator car to move between a locking position and a retracted position in a supported manner along a predefined trajectory, controlled by guide rails.

19. The elevator according to claim 1, wherein the protective wall comprises an upper wall part and a lower wall part, which are connected to each other telescopically, and wherein a detent is connected to the lower wall part, which detent is arranged to force the lock out of the locking position when the lower part is raised as the protective wall is moved from the vertical operating position to the retracted position.

20. The elevator according to claim 1, wherein the protective wall is arranged to be manually returned from the vertical operating position into the retracted position.

* * * * *